United States Patent [19]

Carson

[11] 4,175,903

[45] Nov. 27, 1979

[54] PICK-UP APPARATUS AND CONTAINING ASSEMBLY

[76] Inventor: William S. Carson, 218 Escambia Dr., Winter Haven, Fla. 33880

[21] Appl. No.: 752,194

[22] Filed: Dec. 20, 1976

[51] Int. Cl.[2] ..... B65F 3/14

[52] U.S. Cl. ..... 414/408; 220/324; 414/735; 414/738; 414/422; 294/88; 294/DIG. 2

[58] Field of Search ..... 214/650–653, 214/302, 658, 313, 141, 701 Q, 138 R, 147 AS, 147 G, 518; 220/84, 324; 294/DIG. 2, 99 R, 88; 212/14, 42, 44, 77, 81, 84, 127–129, 135

[56] References Cited

U.S. PATENT DOCUMENTS

| | | | |
|---|---|---|---|
| 2,933,210 | 4/1960 | Dye | 214/80 |
| 3,433,376 | 3/1969 | Jordan | 214/653 |
| 3,713,554 | 1/1973 | Thompson et al. | 214/147 AS |
| 4,005,791 | 2/1977 | Stragier et al. | 214/302 |
| 4,017,092 | 4/1977 | Boomer | 280/47.26 |

FOREIGN PATENT DOCUMENTS

| | | | |
|---|---|---|---|
| 601327 | 1/1960 | Italy | 294/DIG. 2 |

*Primary Examiner*—Albert J. Makay

[57] ABSTRACT

A pick-up apparatus and a container are specially designed to facilitate the lifting of the container and the dumping of its contents. The container includes a frame which has tubular frame members extending between the top and bottom of the container, and a cover is hingedly mounted on the top of the container and can be releasably latched in a closed position by an inertia latch. The pick-up apparatus includes a boom, a pick-up arm mounted on the boom for articulation in a generally horizontal plane, and a pair of clamping arms mounted on the end of the pick-up arm. The clamping arms are slidably mounted on the pick-up arm, and the spacing between the arms can be varied by hydraulic cyinders on the pick-up arm. Each of the clamping arms includes a clamping pad which includes a plurality of flexible, resilient cone-shaped projections which are sized and spaced so that the tubular frame members of the container can be received between the ends of adjacent projections.

12 Claims, 12 Drawing Figures

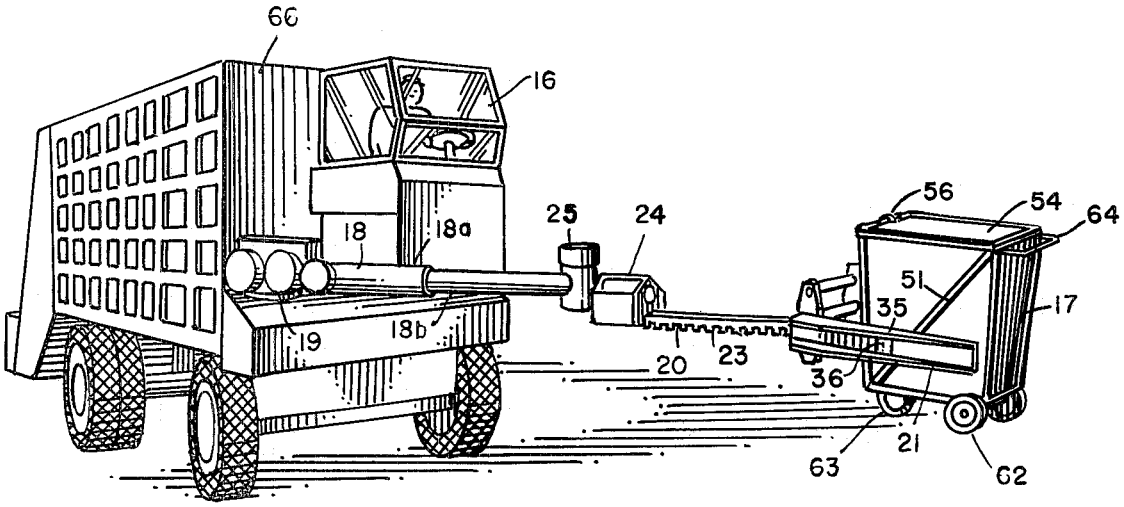
FIG. 2
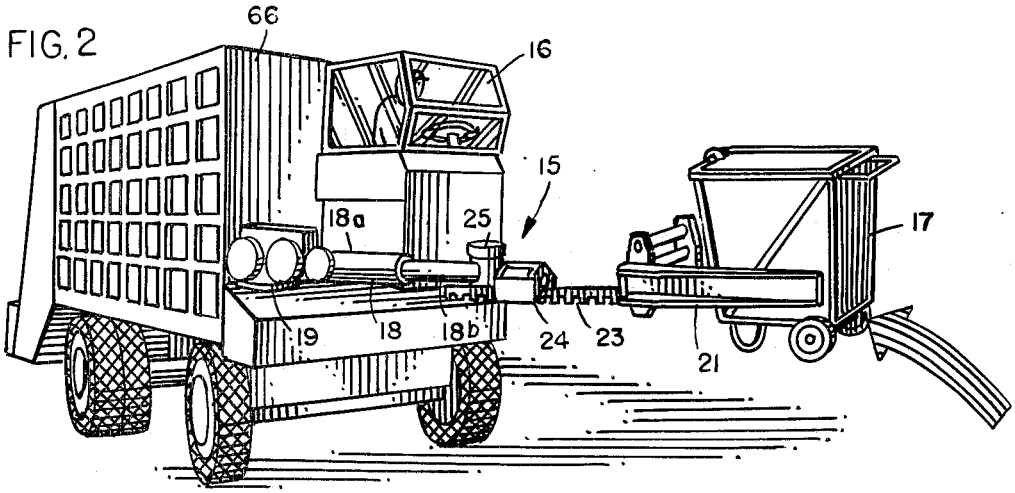
FIG. 3
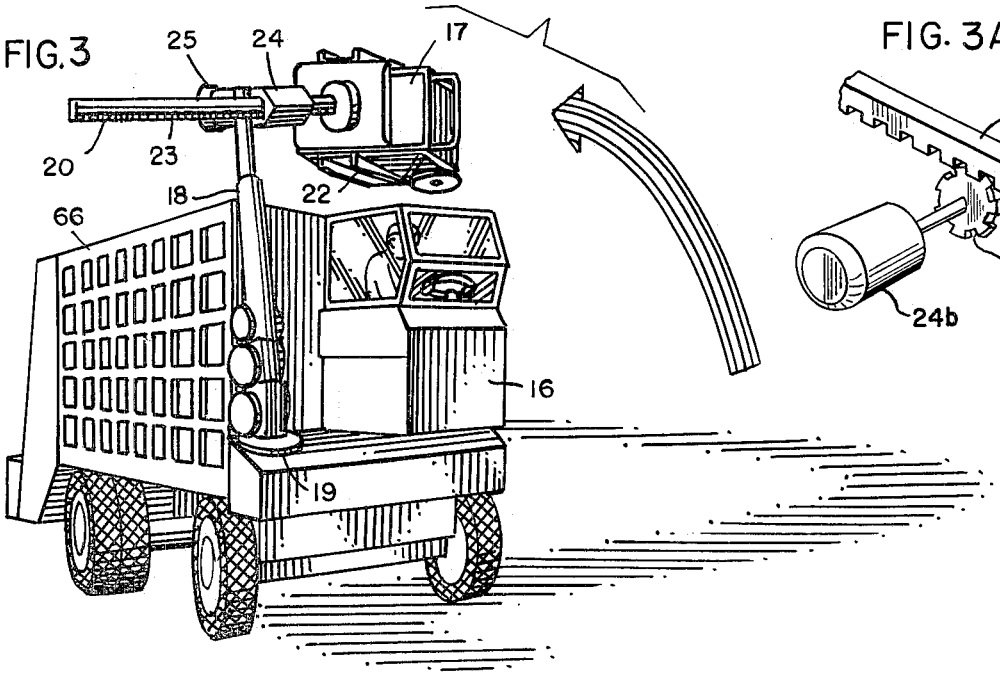
FIG. 3A
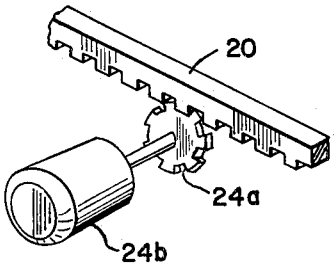

FIG. 4
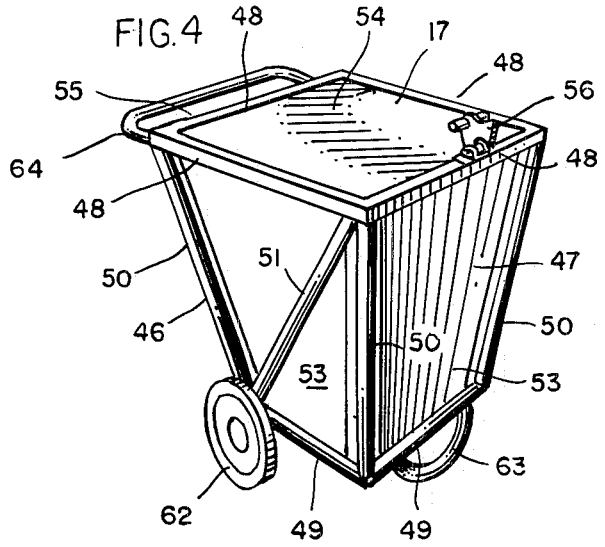
FIG. 5
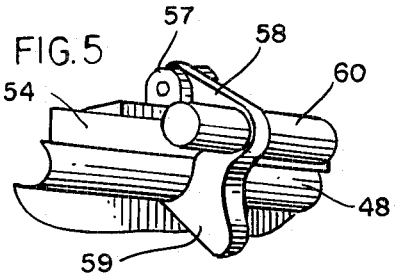
FIG. 6
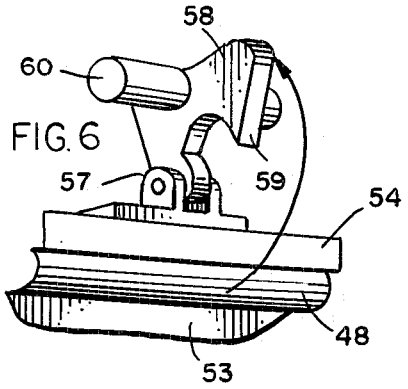
FIG. 7
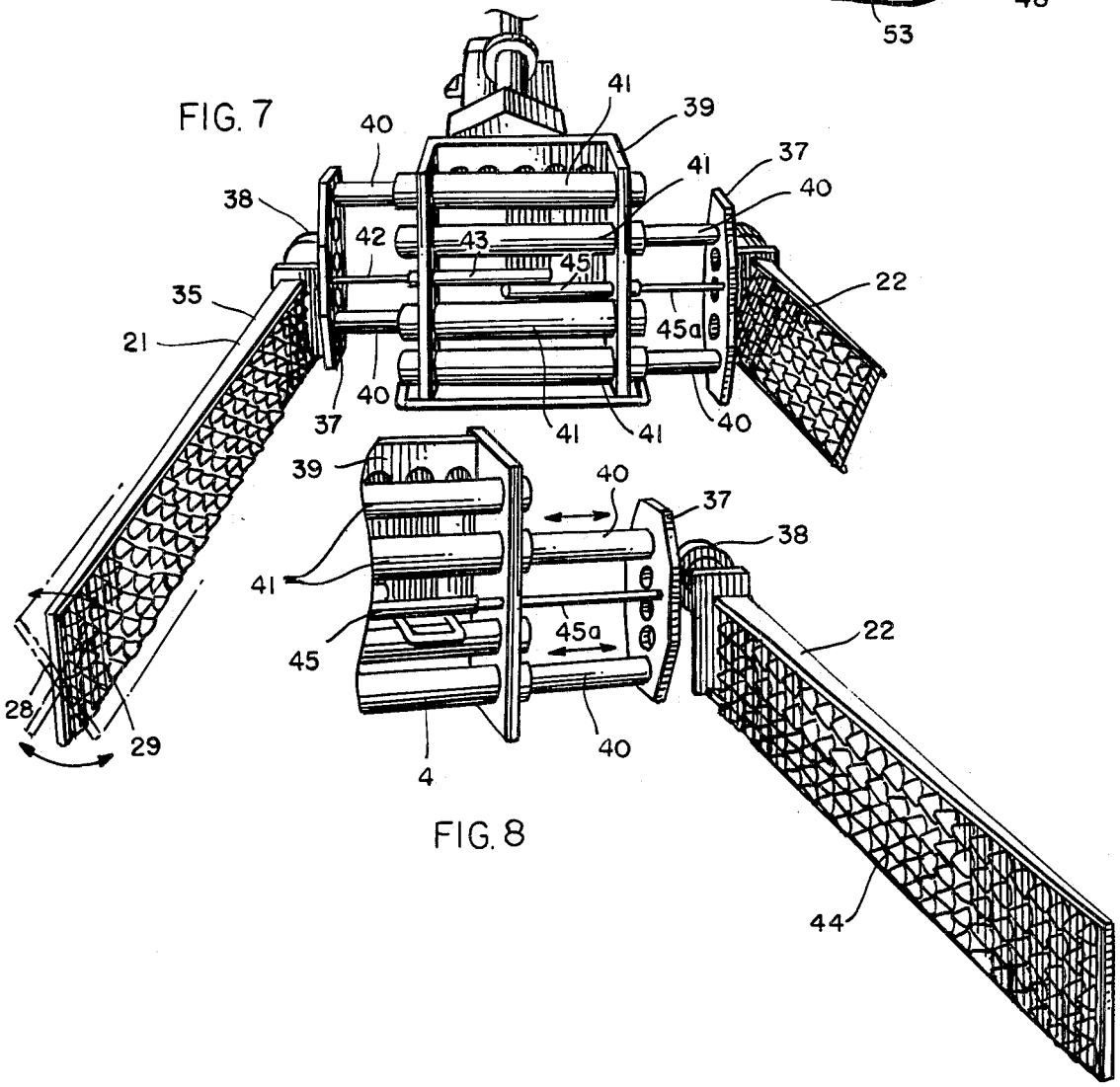
FIG. 8

PICK-UP APPARATUS AND CONTAINING ASSEMBLY

BACKGROUND AND SUMMARY

This invention relates to a pick-up apparatus and a container therefor.

The invention finds particular utility in garbage and refuse pick-up, and will be explained in conjunction therewith. However, it will be understood that the invention is useful for a variety of loading operations. Municipal garbage removal normally is accomplished by a number of men who operate from a garbage or refuse truck. One person drives the truck down the street, while other persons empty the garbage cans of each house along the street into larger containers which are then dumped into the garbage truck. Such an operation is not only time-consuming and physically tiring, but the operation requires a number of men for each truck to accomplish the job efficiently.

The invention permits a municipal garbage removal operation to be accomplished by a single person who merely drives a truck equipped with a pick-up apparatus formed in accordance with the invention down the street or alley between two rows of houses. Each house utilizes containers formed in accordance with the invention, and the pick-up apparatus can quickly pick up and dump the containers on each side of the street or alley.

DESCRIPTION OF THE DRAWING

The invention will be explained in conjunction with an illustrative embodiment shown in the accompanying drawing, in which:

FIG. 1 is a perspective view of a pick-up apparatus formed in accordance with the invention mounted on a vehicle and picking up a container;

FIG. 2 is a view similar to FIG. 1 showing the pick-up arm being raised and retracted;

FIG. 3 is a view showing the boom of the apparatus being raised to lift the container over the vehicle body in order to dump the contents of the container;

FIG. 3A is a fragmentary perspective view showing details of the pinion box;

FIG. 4 is a perspective view of the container;

FIG. 5 is an enlarged fragmentary perspective view of the inertia latch of the container;

FIG. 6 is a view similar to FIG. 5 showing the latch in an open position;

FIG. 7 is a fragmentary perspective view of the clamping arms of the pick-up apparatus;

FIG. 8 is an enlarged fragmentary perspective view of one of the clamping arms showing the sliding attachment to the pick-up arm;

DESCRIPTION OF SPECIFIC EMBODIMENT

Figure 9:
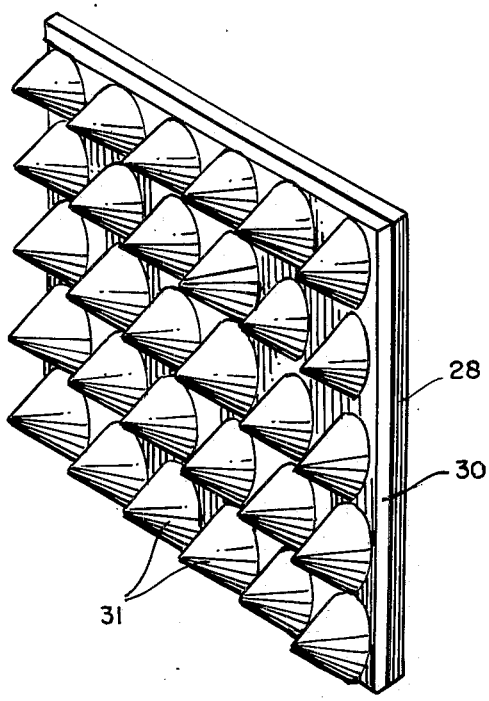
FIG. 9 is an enlarged fragmentary perspective view of one of the clamping pads.

Referring first to FIGS. 1–3, the numeral 15 designates generally a pick-up apparatus which is mounted on a vehicle 16. The pick-up apparatus is shown in an extended position in FIG. 1 and is engaging a container 17 supported on the ground. I have had excellent results in using the invention as a garbage loader, and in the specific embodiment illustrated the vehicle 16 is a garbage truck, and the container is used as a garbage container. It will be understood, however, that the invention can be used in a wide variety of jobs that require a container to be lifted and dumped.

The pick-up apparatus includes a boom 18 which is pivotally mounted on a platform 19. The platform is rotatably mounted on the truck for rotation about a vertical axis, and the boom is pivotable on the platform in a vertical plane. The boom may consist of telescopingly related boom parts **18*a* and 18*b* for increasing or decreasing the length of the boom. Hydraulic motors (not shown) are provided for rotating the platform, for pivoting the boom, and for extending or retracting the inner boom part 18*b***. The details of mounting the boom on the vehicle are conventional and well known in the art and need not be set forth here.

A pick-up arm 20 is mounted on the end of the boom and supports a pair of clamping arms 21 and 22 (see also FIG. 7) for clamping the container. The lower surface of the arm is provided with gear teeth 23, and the pick-up arm, which is essentially a rack, extends through a pinion box 24 in which a pinion **24*a* (FIG. 3A) is mounted in engagement with the gear teeth on the pick-up arm. A hydraulic motor 24*b* in the pinion box rotates the pinion to extend and retract the rack or pick-up arm 23**.

A rotary actuator assembly 25 is mounted on the end of the boom 18 and supports the pinion box 24 and pick-up arm 20. The rotary actuator assembly is also well known to those in the art, and a similar rotary actuator is shown, for example, in U.S. Pat. No. 3,713,554 and is available from Buffalo Hydraulics Division of Houdaille Industries, Inc. The rotary actuator assembly is operated by hydraulic hoses which are omitted for clarity of illustration, as are the hydraulic hoses which operate the pinion for extending the pick-up arm and the hydraulic motors which rotate and pivot the boom. The pick-up arm is rotated by the rotary actuator relative to the boom, and the pick-up arm can be articulated in a horizontal plane when the boom extends horizontally. This is in contrast to the usual hydraulic boom assembly in which the tip boom or secondary boom articulates in a vertical plane.

The operation of the pick-up assembly can be generally described now, and a more detailed description will be provided later. The pick-up arm 20 is extended toward the container 17 by the pinion within the pinion box 24, and the boom 18 and pick-up arm 20 can be rotated in a generally horizontal plane by the platform 19 and by the rotary actuator 25 to position the clamping arms so that they extend parallel to a pair of sides of the container. When the clamping arms extend along the sides of the container, the clamping arms are moved toward each other in a manner to be described hereinafter to grasp the container. The boom 18 is then raised to lift the container off the ground, and the pick-up arm is retracted by the pinion as shown in FIG. 2. The boom 18 is then raised vertically while the rotary actuatory swings the pick-up arm into a generally perpendicular relationship with the boom to bring the container over the dump body 25 of the truck as shown in FIG. 3. The boom is raised until it tilts rearwardly, and the container is inverted somewhat so that the contents of the container will be dumped into the open top of the dump body of the truck.

The details of the clamping arms 21 and 22 are shown in FIGS. 7–12. The clamping arm 21 includes an elongated base plate 28 and a clamping pad 29 mounted on the base plate. The clamping pad is molded from flexible, resilient material, such as urethane or rubber, and includes a flat base 30 (FIGS. 9 and 11) and a plurality of laterally inwardly projecting cone-shaped projections 31 which are arranged in orthogonally related rows and columns. In the particular embodiment illustrated the rows extend parallel to the longitudinal sides 32 and 33 of the base, and the columns extend parallel to the transverse sides 34 of the base.

The base plate 28 is attached to a support arm 35 (FIG. 1) by a connector 36, and the arm is rotatably attached to a vertically extending plate 37 by a trunnion 38 so that the arm and clamping pad can rotate about the longitudinal axis of the arm as indicated in phantom in FIG. 7. The vertical plate 37 is slidably mounted on a frame 39 by rods 40 which are reciprocable within cylinders 41 on the frame, and the vertical plate 37 is moved toward or away from the frame 39 by a piston 42 which reciprocates within a hydraulic cylinder 43. The piston and cylinder form a double-acting hydraulic motor, and a pair of hydraulic hoses (not shown) are connected to the cylinder for extending and retracting the piston.

The clamping arm 22 is similarly formed and mounted. The clamping arm 22 includes a clamping pad 44 and rods 40 which are reciprocable within cylinders 41 on the frame 38. The clamping arm 22 is movable laterally by the hydraulic cylinder 45 and piston **45*a***.

Referring now to FIG. 4, the container 17 includes a frame 46 and a basket or container body 47 which is supported within the frame. The frame is comprised of four orthogonally related upper tubular frame members 48 which provide a rectangularly shaped top opening, four orthogonally related lower tubular frame members 49, four generally vertically extending frame members 50 which connect the upper and lower tubes, and diagonal cross tubes 51 on opposite sides of the frame. One or more bottom support members extend across the bottom of the frame below the basket 47.

The basket and the frame in the illustration given both have the shape of a frustum of a four-sided pyramid. The basket has four flat sides 53 which diverge upwardly and outwardly from a flat bottom, and a cover 54 is secured to one of the sides by hinge 55. The cover and sides of the container are advantageously formed of lightweight plastic sheet, and the frame is advantageously formed from aluminum tube stock. The mating edges of the sides of the container can be suitably joined, as by metal angles, and the container is suitably secured to the frame to prevent removal therefrom.

The cover can be locked in the closed position illustrated in FIG. 4 by an inertia latch 56 which is mounted on the cover. The inertia latch includes a mounting bracket 57 (FIG. 6) and a latch 58 which is pivotally secured to the bracket. The latch is provided with a hook portion 59 and a handle 60 which extends parallel to the pivot axis of the latch.

When the cover is closed, the latch 58 can be pivoted downwardly so that the hook portion 59 thereof will extend below and engage the lower portion of the tubular frame member 48 (FIG. 5). The spacing between the pivot of the latch and the frame member is such that the cover will be drawn against the frame member when the latch is pushed into the locking position. A frictional force on the latch is thereby created which prevents the latch from being moved inadvertently out of the locking position.

The container shown in the drawing is suitable for use as a garbage or refuse container and includes a pair of wheels 62, a stand 63 attached to the bottom of the frame, and a handle 64 attached to the top. The container can therefore be easily transported from its usual location to a pick-up location along a street or an alley.

As described previously, the container is engaged by the pick-up apparatus by advancing the spaced-apart clamping arms 21 and 22 toward the container until the clamping arms extend along opposite sides of the container. It is desirable that the owner of the container be instructed to position the container alongside the street or alley so that the side of the container which carries the latch generally faces the path along which the garbage truck drives. This permits the clamping arms to engage the sides of the container frame which are provided with the diagonal frame members 51 and permits the cover to open properly as will be described hereinafter.

The position of the clamping arms relative to the container can be adjusted by swinging the boom 18 and pivoting the pick-up arm until the clamping arms extend parallel to opposite sides of the container. The pick-up arm is then extended by the pinion box 24 until the clamping arms extend beyond the sides of the container. The clamping arms are then moved toward each other to clamp the container by retracting the pistons **45*a* and 42** (FIG. 7).

As the clamping arms move against the container frame, the tubular frame members are engaged by the cone-shaped projections 31 (FIGS. 9–11) of the clamping pads. The tubular frame members 50 and 51 are shown in phantom in FIG. 10 in positions which they might occupy relative to the cones as the clamping arm is moved against the frame. The diameter of the frame tubes is less than the spacing between the peaks of adjacent cones but greater than the spacing between the bases of adjacent cones. Although the tubes will not be aligned with the valleys between the columns of cones, the peaks of the flexible cones will be pushed laterally with respect to the cone axis as the cones are pushed against the tubes as illustrated by the cone **31*a* in FIG. 11. In some cases a tube may be positioned in a valley between two adjacent cones, as in FIG. 12**, and those particular cones will not be displaced. Other cones lying along the length of the tube will be displaced to varying degrees.

The trunnions 38 which support the clamping arms permit the clamping arms to float on a generally horizontal axis so that the clamping arms will lie flush against the sides of the container even if the sides are not vertical. For example, even though the sides of the container illustrated in the drawing diverge upwardly and outwardly, the clamping arms will rotate about a horizontal axis as they engage the sides of the container to bring the clamping arms flush against the sides.

Figure 10:
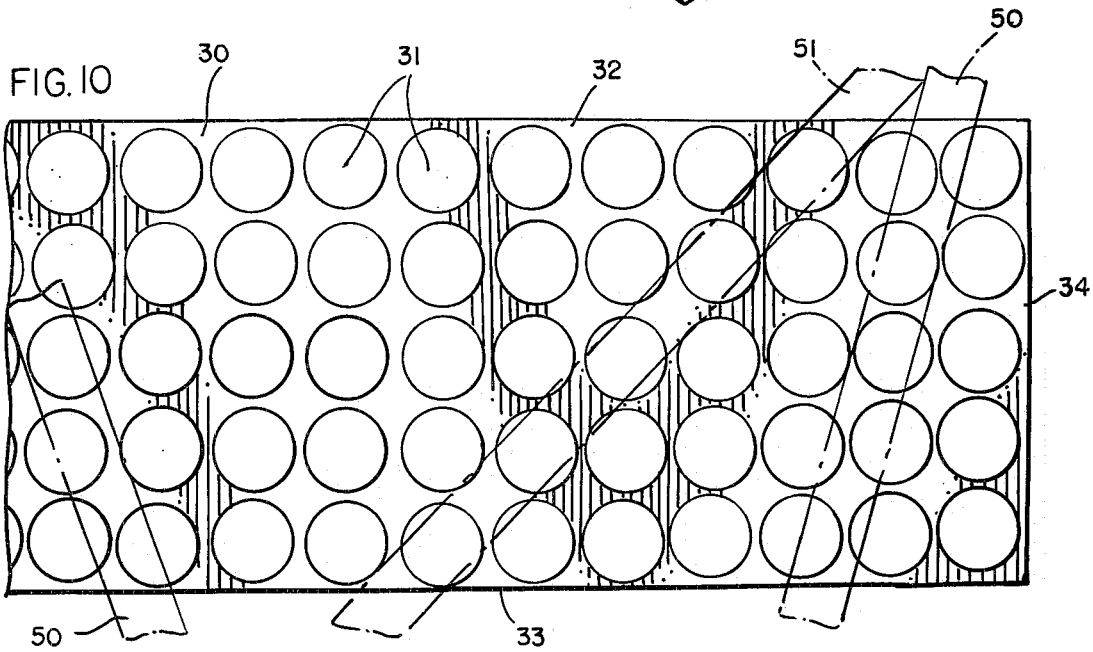
FIG. 10 is an enlarged fragmentary elevational view of one of the clamping pads.
Figure 11:
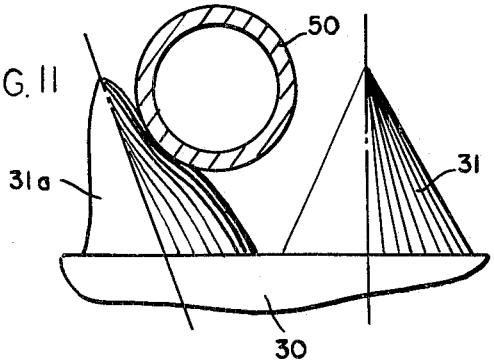
FIG. 11 is a fragmentary sectional view through one of the clamping pads showing a tubular frame member of the container positioned between two of the projections on the clamping pad.
Figure 12:
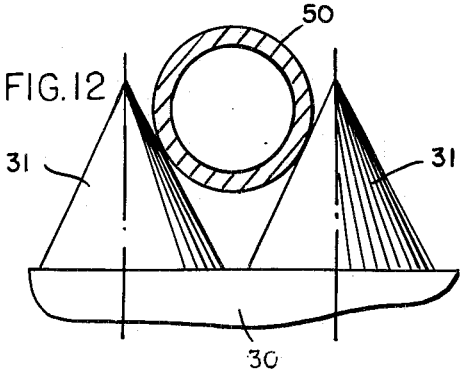
FIG. 12 is a sectional view similar to FIG. 11 taken at another location showing the tubular frame member centered between the projections.

Each of the tubes which are engaged by the clamping pads will be engaged by cones on opposite sides of the longitudinal axis of the cone, and the flexible and resilient cones provide a cushioned yet firm engagement between the clamping arms and the container frame which creates a secure grip on the container frame without excessive squeezing or compressive force. The container is therefore raised with the clamping arms as the boom is raised. As can be seen in FIG. 10, the tubes extend angularly with respect to the columns and rows of cones, and any tendency of the tubes to slip downwardly relative to the cones is thereby minimized. Further, the plastic or rubber material of the cones provides a substantial frictional retention force. The diagonal tubes 51 extend across both the columns and the rows of the cones at acute angles and ensures that the container will not slip downwardly relative to the cones. If desired, the tubes 51 could extend horizontally to provide this anti-slipping function.

As illustrated in FIGS. 1-3, after the container is clamped by the clamping arms, the pick-up arm is retracted and hydraulic motors for the boom 18 and rotary actuator 25 are actuated to rotate the pick-up arm into a substantially perpendicular relationship with the boom and to pivot the boom upwardly. As the container is raised and tilted by the pick-up apparatus, the inertia latch maintains the cover of the container in its closed position. As the boom is pivoted toward the dump body of the truck, it eventually passes over a perfectly vertical position, becomes inclined toward the body, and begins to swing downwardly. The boom swings downwardly beyond a vertical position until it engages the upper edge portion 66 (FIG. 1) of the dump body, which may be suitably reinforced to prevent deformation or other damage. When the pick-up apparatus and the container are brought to an abrupt halt by the engagement of the boom with the dump body, the inertia latch pivots away from its closed position and the cover of the container swings open to allow the contents of the container to fall into the dump body.

The handle 60 of the inertia latch is formed from solid metal to provide a substantial weight at a point spaced from the pivot of the latch. The inertia of the handle when the downward movement of the container is abruptly halted causes the latch to overcome the frictional force which tends to keep the latch closed and to pivot downwardly away from its closed position.

After the contents of the container have been dumped into the body of the truck, the container is returned to its original location on the ground by actuating the boom 18, the rotary actuator 25, the pinion box 24, and the pistons 39 and 42. When the clamping arms are separated to release the container, the resilient cones of the clamping pads return to their original, aligned positions.

The invention permits a single person to empty the garbage containers along an entire block of homes on both sides of a street or alley merely by driving down the street or alley. The driver merely stops the truck slightly before each container and operates the pick-up apparatus to engage and lift the container. Since the rotational axis of the pick-up arm 20 extends perpendicularly to the rotational axis of the boom 18, the pick-up arm articulates in a horizontal plane when the boom is horizontal. The pick-up arm can therefore swing horizontally to pick up containers on both sides of the truck, and containers on both sides of the street or alley can be picked up as the truck moves down the center of the street or alley.

Although both of the clamping arms are movably mounted on the pick-up arm in the embodiment which I have described, the clamping arms could still be moved relative to each other to engage the container if only one of the pick-up arms were movable.

While in the foregoing specification a detailed description of a specific embodiment of the invention has been set forth for the purpose of illustration, it is to be understood that many of the details herein given may be varied considerably without departing from the spirit and scope of the invention.

I claim:

1. A container and pick-up assembly comprising in combination a container and a pick-up apparatus, the container having a top and bottom and a plurality of tubular members between the top and bottom, the pick-up apparatus having a pick-up arm, means for raising and lowering the pick-up arm, a pair of clamping arms movably mounted on the pick-up arm for movement toward and away from each other, means for moving the clamping arms toward and away from each other, each of the clamping arms having a plurality of spaced-apart flexible and resilient projections mounted thereon and extending toward the other clamping arm, the spaced-apart projections on each clamping arm providing grooves therebetween for receiving the tubular members on the container whereby the container may be lifted by positioning the container between the clamping arms and moving the clamping arms toward each other to clamp the projections thereon about the tubular members of the container.

2. The structure of claim 1 in which the minimum spacing at the base between adjacent projections on each of the clamping arms is less than the diameter of the tubular members.

3. The structure of claim 1 in which the maximum spacing at the peaks between adjacent projections on each of the clamping arms is greater than the diameter of the tubular members.

4. The structure of claim 1 in which the projections are formed from molded urethane material.

5. The structure of claim 1 in which the projections are cone-shaped.

6. The structure of claim 1 in which the container includes a pair of opposed generally vertically extending sides, the tubular members being mounted on each of the sides and extending generally vertically between the top and the bottom of the container.

7. The structure of claim 6 including a tubular member on each of said opposed sides which extends generally diagonally between the top and the bottom of the container.

8. The structure of claim 1 including a cover hingedly mounted on the top of the container and an inertia latch movable between a locking position and an unlocking position for releasably locking the cover in a closed position, the inertia latch maintaining the cover closed when the latch is in its locking position while the container is raised and inverted by the pick-up arm until movement of the container is brought to an abrupt stop.

9. The structure of claim 8 in which the inertia latch is pivotally mounted on the cover and includes a weight spaced from the pivot.

10. The structure of claim 1 in which the means for moving the clamping arms toward and away from each other is at least one piston and cylinder assembly for each clamping arm.

11. The structure of claim 1 in which the pick-up apparatus includes means for extending and retracting the pick-up arm toward and away from the container.

12. The structure of claim 1 in which the pick-up apparatus includes means for rotating the pick-up arm in a generally horizontal plane for positioning the clamping arms adjacent the container.

* * * * *